US009523231B2

(12) United States Patent
Ciavaglia et al.

(10) Patent No.: US 9,523,231 B2
(45) Date of Patent: Dec. 20, 2016

(54) ATTACHMENT ASSEMBLY AND DRIVE UNIT HAVING SAME

(75) Inventors: Michael A. Ciavaglia, Dearborn, MI (US); John R. Rice, New Baltimore, MD (US); Joseph M. Johnson, Norwood, MA (US); Lloyd W. Rogers, Jr., Washington, MI (US); Howard W. Kuhlman, Rochester Hills, MI (US); Brian N. Orr, Chesterfield, MI (US); Eric R. Hansen, Lake Orion, MI (US)

(73) Assignee: STRATTEC POWER ACCESS LLC, Troy, MI (US)

( * ) Notice: Subject to any disclaimer, the term of this patent is extended or adjusted under 35 U.S.C. 154(b) by 1035 days.

(21) Appl. No.: 12/872,451

(22) Filed: Aug. 31, 2010
(Under 37 CFR 1.47)

(65) Prior Publication Data

US 2011/0245001 A1 Oct. 6, 2011

Related U.S. Application Data

(63) Continuation-in-part of application No. 11/221,499, filed on Sep. 8, 2005, now Pat. No. 7,806,012, which is (Continued)

(51) Int. Cl.
*E05F 15/00* (2015.01)
*E05F 15/63* (2015.01)
*E05F 15/627* (2015.01)

(52) U.S. Cl.
CPC ..... *E05F 15/63* (2015.01); *E05F 15/627* (2015.01); *E05Y 2201/216* (2013.01);
(Continued)

(58) Field of Classification Search
CPC ..... E05F 15/627
(Continued)

(56) References Cited

U.S. PATENT DOCUMENTS 587,710 A * 8/1897 Decker ..... 474/112
1,218,686 A 3/1917 Morse
(Continued)

FOREIGN PATENT DOCUMENTS

DE 28 02 563 * 7/1979
DE 4113391 11/1991
(Continued)

OTHER PUBLICATIONS

Posic, Digital Inductive Position, Speed and Direction Sensor, PO1210, PO1210-DS-V2B, pp. 1-3.
(Continued)

*Primary Examiner* — William C Joyce
(74) *Attorney, Agent, or Firm* — Michael Best & Friedrich LLP

(57) ABSTRACT

A drive unit comprising a guide channel that has a first pulley at one end that rotates about a fixed pulley axis. The drive unit also includes a flexible drive member having a plurality of spaced windows, an attachment assembly moveably attached to the guide channel, and an adjustable pulley assembly coupled to the guide channel that has a second pulley that rotates around a moveable pulley axis that can be adjusted to change the distance between the fixed pulley axis and the moveable pulley axis to take up slack in the flexible drive member.

15 Claims, 9 Drawing Sheets

Related U.S. Application Data a continuation-in-part of application No. 10/784,333, filed on Feb. 23, 2004, now Pat. No. 7,297,082, application No. 12/872,451, which is a continuation-in-part of application No. 11/217,113, filed on Aug. 31, 2005, now Pat. No. 7,785,220.

(60) Provisional application No. 60/519,021, filed on Nov. 10, 2003, provisional application No. 60/616,259, filed on Oct. 6, 2004.

(52) U.S. Cl.
CPC ... *E05Y 2201/246* (2013.01); *E05Y 2201/462* (2013.01); *E05Y 2900/546* (2013.01)

(58) Field of Classification Search
USPC ..... 74/89.2, 89.21, 89.22, 501.5 R; 49/324, 49/334, 345, 352, 360; 59/93; 403/339, 340, 403/385, 388; 474/112, 202, 206, 237; 198/728, 198/731, 733
See application file for complete search history.

(56) References Cited

U.S. PATENT DOCUMENTS 1,486,962 A * 3/1924 Heintz ..... 16/211
2,675,709 A * 4/1954 Dowdy ..... 474/89
2,921,700 A * 1/1960 Reed, Jr. ..... 414/545
3,148,893 A 9/1964 Cole et al.
3,481,074 A * 12/1969 Moss ..... E05F 15/686 160/188
3,653,154 A 4/1972 Hayday
3,733,919 A 5/1973 Rupp, II
4,019,354 A 4/1977 O'Dell
4,121,382 A 10/1978 Dietrich et al.
4,163,432 A 8/1979 Hertfelder
4,174,865 A 11/1979 Doveinis
4,184,577 A 1/1980 Miller
4,191,068 A 3/1980 Jardin et al.
4,222,588 A 9/1980 Suzuki et al.
4,223,927 A 9/1980 Kobayashi et al.
4,237,744 A 12/1980 Jolly
4,247,001 A 1/1981 Wiegner
4,257,001 A 3/1981 Partain et al.
4,281,475 A 8/1981 Spadoni-Censi
4,285,421 A 8/1981 Halsted
4,320,620 A 3/1982 Rieger et al.
4,462,185 A 7/1984 Shibuki et al.
4,480,743 A 11/1984 Dehne
4,504,252 A * 3/1985 Honma ..... 474/112
4,524,591 A 6/1985 Lanka
4,526,251 A 7/1985 Johannson
4,530,185 A 7/1985 Moriya et al.
4,541,502 A 9/1985 Iwai et al.
4,566,576 A 1/1986 Moriya et al.
4,640,050 A 2/1987 Yamagishi et al.
4,644,693 A 2/1987 Wang
4,744,449 A 5/1988 Sekella et al.
4,763,936 A 8/1988 Rogakos et al.
4,790,425 A 12/1988 Braun et al.
4,880,199 A 11/1989 Harney
4,893,435 A * 1/1990 Shalit ..... E05F 15/643 49/139
4,916,861 A 4/1990 Schap
4,932,715 A 6/1990 Kramer
4,938,651 A 7/1990 Gilmor et al.
4,945,677 A 8/1990 Kramer
4,952,080 A 8/1990 Boiucaner et al.
4,966,045 A 10/1990 Harney
4,984,668 A 1/1991 Onishi et al.
5,004,280 A 4/1991 Schap
5,014,958 A 5/1991 Harney
5,039,925 A 8/1991 Schap
5,046,283 A 9/1991 Compeau et al.
5,066,056 A 11/1991 Schap
5,076,016 A 12/1991 Adams et al.
5,105,131 A 4/1992 Schap
5,127,190 A 7/1992 Hein et al.
5,138,795 A 8/1992 Compeau et al.
5,168,666 A * 12/1992 Koura ..... B60J 5/06 49/280
5,216,780 A 6/1993 Lutzke et al.
5,263,762 A 11/1993 Long et al.
5,295,038 A 3/1994 Matsushita et al.
5,313,795 A 5/1994 Dunn
5,316,365 A 5/1994 Kuhlman et al.
5,319,880 A 6/1994 Kuhlman
5,319,881 A 6/1994 Kuhlman
5,323,570 A 6/1994 Kuhlman et al.
5,347,755 A 9/1994 Jaster et al.
5,350,986 A 9/1994 Long et al.
5,351,439 A 10/1994 Takeda et al.
5,396,158 A 3/1995 Long et al.
5,427,581 A * 6/1995 McGrath et al. ..... 474/101
5,434,487 A 7/1995 Long et al.
5,477,093 A 12/1995 Lamb
5,477,094 A 12/1995 Lamb
5,507,119 A 4/1996 Sumiya et al.
5,582,279 A 12/1996 Buchanan, Jr. et al.
5,623,785 A * 4/1997 Mariel ..... E05F 11/485 49/352
5,668,424 A 9/1997 Lamb
5,676,615 A 10/1997 McGrath et al.
5,691,587 A 11/1997 Lamb
5,737,876 A 4/1998 Dowling
5,755,059 A 5/1998 Schap
5,813,282 A 9/1998 Azuma
5,867,940 A 2/1999 Watanaba et al.
5,884,433 A * 3/1999 Watanabe ..... F16C 1/22 49/360
5,892,340 A 4/1999 Sasajima et al.
5,906,071 A 5/1999 Buchanan, Jr.
5,909,073 A 6/1999 Lamb
5,913,563 A 6/1999 Watanabe et al.
5,979,114 A 11/1999 Clark et al.
5,982,126 A 11/1999 Hellinga et al.
6,009,671 A 1/2000 Sasaki et al.
6,032,415 A 3/2000 Tajima
6,037,727 A 3/2000 Kawanobe et al.
6,043,644 A 3/2000 de Coulon et al.
6,088,965 A * 7/2000 Fukumoto et al. ..... 49/352
6,100,619 A 8/2000 Buscher et al.
6,114,820 A 9/2000 Nishigaya
6,125,586 A 10/2000 Buscher
6,134,836 A 10/2000 Kawanobe et al.
6,179,742 B1 1/2001 Haag et al.
6,198,242 B1 * 3/2001 Yokomori ..... E05F 15/646 192/54.5
6,199,322 B1 3/2001 Itami et al.
6,216,393 B1 4/2001 Apprich
6,231,113 B1 5/2001 Armbruster et al.
6,247,373 B1 6/2001 Bree et al.
6,270,148 B1 8/2001 Noda et al.
6,270,149 B1 8/2001 Fukumoto et al.
6,283,535 B1 9/2001 Yuge
6,313,795 B1 11/2001 Herrmann et al.
6,367,199 B2 4/2002 Sedlak et al.
6,367,864 B2 4/2002 Rogers, Jr. et al.
6,367,964 B1 4/2002 Schmelz et al.
6,378,392 B1 4/2002 Dombrowski et al.
6,397,523 B1 6/2002 Fukumoto et al.
6,405,485 B1 6/2002 Itami et al.
6,405,486 B1 6/2002 Rogers et al.
6,408,573 B1 6/2002 Fukumoto et al.
6,425,206 B1 7/2002 Noda et al.
6,430,875 B1 8/2002 Clark et al.
6,453,614 B1 9/2002 Rogers, Jr. et al.
6,460,295 B1 10/2002 Johnson et al.
6,464,287 B2 10/2002 Rogers, Jr. et al.
6,481,783 B1 11/2002 Rogers, Jr. et al.
6,575,864 B1 6/2003 Dean
6,588,829 B2 7/2003 Long et al.
6,669,247 B2 12/2003 Swan

(56) References Cited

U.S. PATENT DOCUMENTS

| | | | | |
|---|---|---|---|---|
| 6,863,336 | B2 | 3/2005 | Yokomori et al. | |
| 6,964,449 | B2 | 11/2005 | Takeda et al. | |
| 7,021,003 | B2 | 4/2006 | Daniels et al. | |
| 7,159,930 | B2 * | 1/2007 | Yokomori | B60J 5/06 296/155 |
| 7,297,082 | B2 | 11/2007 | Rice et al. | |
| 7,785,220 | B2 | 8/2010 | Ciavaglia et al. | |
| 7,806,012 | B2 | 10/2010 | Rice et al. | |
| 2001/0022049 | A1 | 9/2001 | Clark et al. | |
| 2003/0046872 | A1 | 3/2003 | Fukumura et al. | |
| 2003/0106757 | A1 | 6/2003 | Johnson et al. | |
| 2003/0136054 | A1 | 7/2003 | Daniels et al. | |
| 2004/0172883 | A1 | 9/2004 | Rogers et al. | |
| 2004/0216383 | A1 | 11/2004 | Rogers, Jr. et al. | |

FOREIGN PATENT DOCUMENTS

| | | | |
|---|---|---|---|
| DE | 4132293 | | 4/1992 |
| DE | 4041480 | | 6/1992 |
| DE | 19712185 | | 3/1998 |
| DE | 19714214 | | 10/1998 |
| DE | 19724009 | | 12/1998 |
| EP | 0421776 | | 4/1991 |
| EP | 0609585 | | 8/1994 |
| EP | 0611869 | | 8/1994 |
| EP | 0625625 | | 11/1994 |
| EP | 0625815 | | 11/1994 |
| EP | 0626498 | | 11/1994 |
| EP | 0 732 476 | * | 9/1996 |
| EP | 0980776 | | 2/2000 |
| FR | 2603647 | | 3/1988 |
| GB | 2097855 | | 11/1982 |
| GB | 2323124 | | 9/1998 |
| JP | 5255117 | | 5/1977 |
| JP | 5530060 | | 3/1980 |
| JP | 57111972 | | 7/1982 |
| JP | 57117171 | | 7/1982 |
| JP | 58028115 | | 2/1983 |
| JP | 358030827 | | 2/1983 |
| JP | 6136481 | | 5/1994 |
| JP | 7067293 | | 3/1995 |
| JP | 2000160933 | | 6/2000 |
| JP | 2000177391 | | 6/2000 |
| WO | 2004025063 | | 3/2004 |

OTHER PUBLICATIONS

Posic, Preliminary PO1230 Inductive Thumbwheel Sensor, (2 pages).
Posic, Microcoil Inductive Position Sensor, (1 page).
Mattan Kamon, Anne-Marie Nguyen, John R. Gilbert, "A Design Tool for Inductive Position and Speed Sensors via a Fast Integral Equation Based Method", (5 pages).
Toyota, Tecno brochure, dated Aug. 1995.
Y. De Coulon, C. Bourgeois, H. De Lambilly, J. Bergqvist, P. Roze, P. Biton, Microcoil Speed and Position Sensor for Automotive Applications, dated 1997, (3 pages).
Electronic Design, a Penton Publication, Integration and Inductive Sensing Combine to Improve Automotive/Industrial Sensing, dated Jul. 12, 1999, (2 pages).
Circuit Cellar, Inductive Sensors, Issue 132, dated Jul. 2001, pp. 1-4.
Posic, Application Note—Mechanical and Electrical Interfacing of PO1210, dated Jul. 6, 2002, pp. 1-8.
Allegro Microsystems, Inc., ATS650LSH-Preliminary Data Sheet, Two-Wire, Direction-Detection Gear Tooth Sensor with Diagnostic Output, dated Aug. 12, 2003, pp. 1-6.
Posic Sensor + Test 2005, (8 pages).
Office Action to U.S. Appl. No. 10/784,333, dated Apr. 4, 2007, (7 pages).
Office Action to U.S. Appl. No. 11/217,113, dated Sep. 8, 2008, (15 pages).
Office Action to U.S. Appl. No. 11/400,250, dated Nov. 13, 2008, (11 pages).
Office Action to U.S. Appl. No. 11/217,113 dated Feb. 19, 2009, (19 pages).
Office Action to U.S. Appl. No. 11/217,113, dated Jun. 10, 2009, (18 pages).
Office Action to U.S. Appl. No. 11/400,250, dated Jun. 23, 2009, (12 pages).
Office Action to U.S. Appl. No. 11/221,499, dated Nov. 19, 2009, (10 pages).
Office Action to U.S. Appl. No. 11/400,250, dated Jan. 19, 2010, (14 pages).
Posic, Evaluation Kit for PO1210 digital Inductive Position Sensor, PO1201EVK, pp. 1-4.

* cited by examiner

ATTACHMENT ASSEMBLY AND DRIVE UNIT HAVING SAME

RELATED APPLICATIONS

This patent application is a continuation-in-part of U.S. patent application Ser. No. 11/221,499, filed Sep. 8, 2005, which is a continuation-in-part of U.S. patent application Ser. No. 10/784,333, filed Feb. 23, 2004, now U.S. Pat. No. 7,297,082, which claims benefit of provisional patent application No. 60/519,021, filed Nov. 10, 2003. U.S. patent application Ser. No. 11/221,449 also claims benefit of provisional patent application No. 60/616,259, filed Oct. 6, 2004. The present patent application is also a continuation-in-part of U.S. patent application Ser. No. 11/217,113, filed Aug. 31, 2005, which claims priority to U.S. Provisional Patent Application No. 60/616,259, filed Oct. 6, 2004. Each of the above referenced applications is hereby incorporated by reference.

FIELD OF INVENTION

This invention relates to an attachment assembly for a drive unit having a flexible drive member that is suitable for use in a power operated closure system such as, for example, a power operated lift-gate system in an automotive vehicle.

BACKGROUND OF THE INVENTION

U.S. Pat. No. 6,367,864 B2 granted to Lloyd Walker Rogers, Jr. et al. Apr. 9, 2004 discloses a vehicle having a power operated lift-gate system that includes at least one drive unit. The drive unit comprises a fixed linear guide channel and an attachment assembly that moves in the guide channel. A rod is universally connected to the attachment assembly at one end and universally connected to the lift-gate at the opposite end. An endless flexible drive member that is attached to the attachment assembly wraps part way around two idler pulleys at the opposite ends of the guide channel and travels in a closed loop. The flexible drive member is driven by a bi-directional power unit that includes a drive sprocket. The drive sprocket drivingly engages the loop of the flexible drive member outside the drive channel midway between the two idler pulleys. The use of a flexible drive member raises a need for an attachment assembly that is simple and efficient, durable and economical to manufacture and assemble.

SUMMARY OF THE INVENTION

The invention provides an attachment assembly for attaching a flexible drive member to a driven member that is compact, economical and durable.

The attachment assembly comprises a yoke having laterally spaced side walls connected by a bridge wall, a connector attached to the bridge wall, and a coupler disposed between the side walls and attached to the yoke. The coupler has a plurality of spaced teeth for engaging in windows of the flexible drive member. An outer shoe engages each side wall of the yoke.

Each outer shoe preferably has a recess receiving the associated side wall and each outer shoe preferably has longitudinally spaced, forward, resilient bows and longitudinally spaced resilient side bows to facilitate sliding of the attachment in a channel. The attachment assembly may include an optional tensioning spring and the outer shoes may include fingers to provide an anti-rattle feature.

The flexible drive member attachment is preferably used in connection with a drive chain but can be adapted for attachment to other flexible drive members such as a flexible drive belt having spaced windows.

In one aspect, this invention provides a drive unit having an endless flexible drive member that is more compact than the drive unit that is disclosed in the Rogers et al. '864 patent.

In another aspect, this invention provides a compact drive unit that includes an adjustable pulley assembly to take up slack in the flexible drive member.

In yet another aspect this invention provides an adjustable pulley assembly that is unique, compact and economical.

DETAILED DESCRIPTION OF PREFERRED EMBODIMENTS

Figure 1:
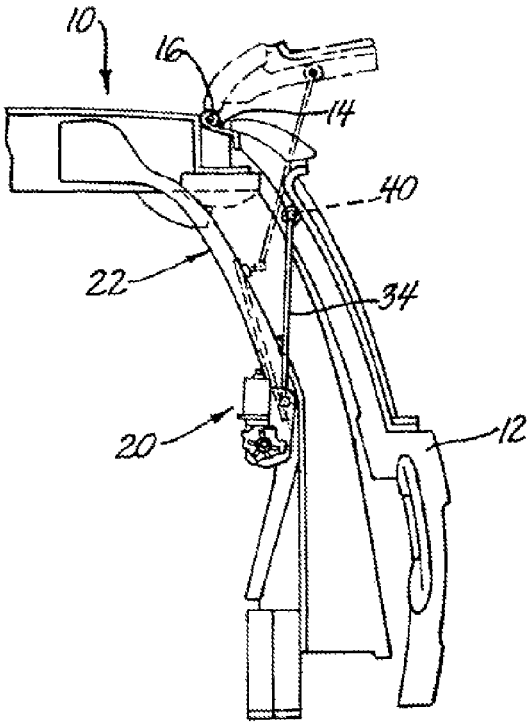
FIG. 1 is a fragmentary rear view of a vehicle equipped with a power operated lift-gate that includes an attachment assembly and drive unit of the invention.
Figure 2:
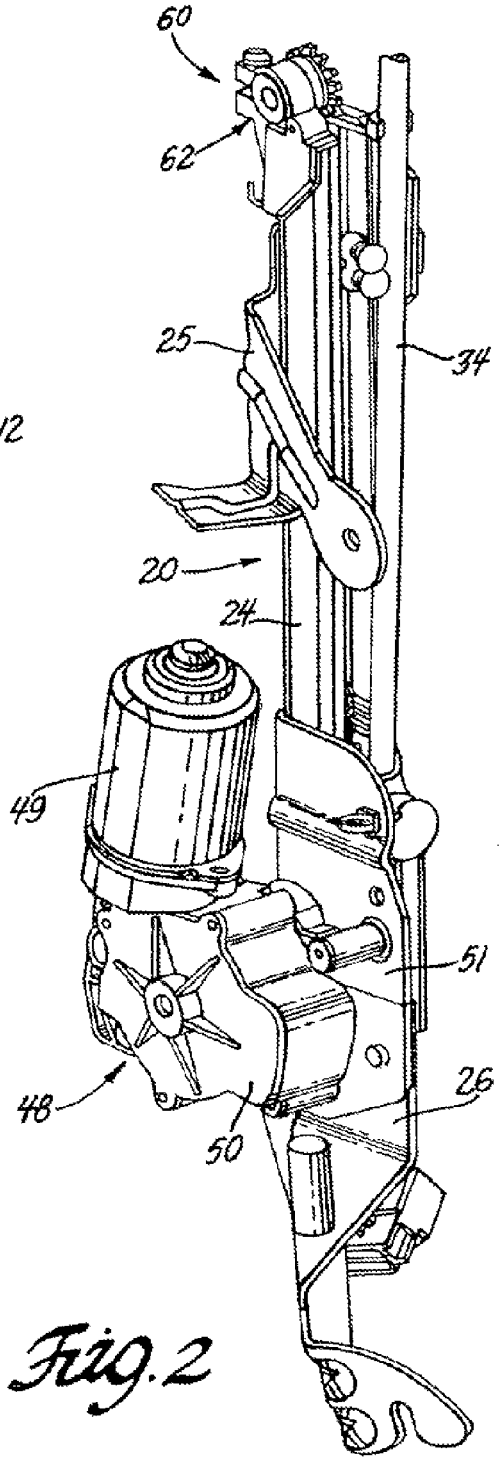
FIG. 2 is a perspective view of the drive unit shown in FIG. 1.

Referring now to the drawings, vehicle 10 has a closure or lift-gate 12 that is attached to the aft end of the vehicle roof by two hinge assemblies 14. Hinge assemblies 14 have hinge portions that are secured to a roof channel of the vehicle 10 and hinge portions that are secured to lift-gate 12 so that lift-gate 12 pivots about a substantially horizontal hinge axis 16 between a closed position shown in solid line in FIG. 1 and an open position shown in dashed lines in FIG. 1. Lift-gate 12 is generally permitted to pivot about 90° about the substantially horizontal hinge axis 16. However, the range of movement can be varied substantially from one model of vehicle to another.

Lift-gate 12 is opened and closed manually or by a suitable power operated closure system comprising two identical drive units 20 that are installed in the aft end of the vehicle body at the respective vertical body pillars 22, commonly referred to as the D pillars, that define the width of the rear opening that is closed by lift-gate 12. The typical drive unit 20 is shown in greater detail in FIGS. 2 through 6.

Each power unit 20 comprises a fixed rectangular guide channel 24 that is fixed to a body portion of the vehicle in a generally vertical orientation by upper and lower brackets 25 and 26 at or near the D pillar 22.

The rectangular guide channel 24 has an elongated longitudinal slot 27 in a rearward facing wall 28 of the guide channel 24 that faces toward lift-gate 12 when lift-gate 12 is in the closed position.

An attachment assembly 30 is disposed in the guide channel 24 and moves along in the guide channel. Attachment Assembly 30 has a universal connector in the form of a ball stud 32 that projects through slot 27. A rod 34 has a mating universal connector in the form of a socket 36 at one end that receives the ball stud 32 so that rod 34 is universally connected to assembly 30. Rod 34 has a socket 38 at an opposite end that is universally connected to a mating ball stud 40 attached to a side wall of the vehicle lift gate 12. It should be understood that any type of universal connector can be used between rod 34 and attachment assembly 30 at one end of rod 34 and between rod 34 and lift-gate 12 at the other end of rod 34 and that the positions of the ball studs and the sockets of the ball joints 32, 36 and 38, 40 of illustrated example can be reversed.

Figure 5:
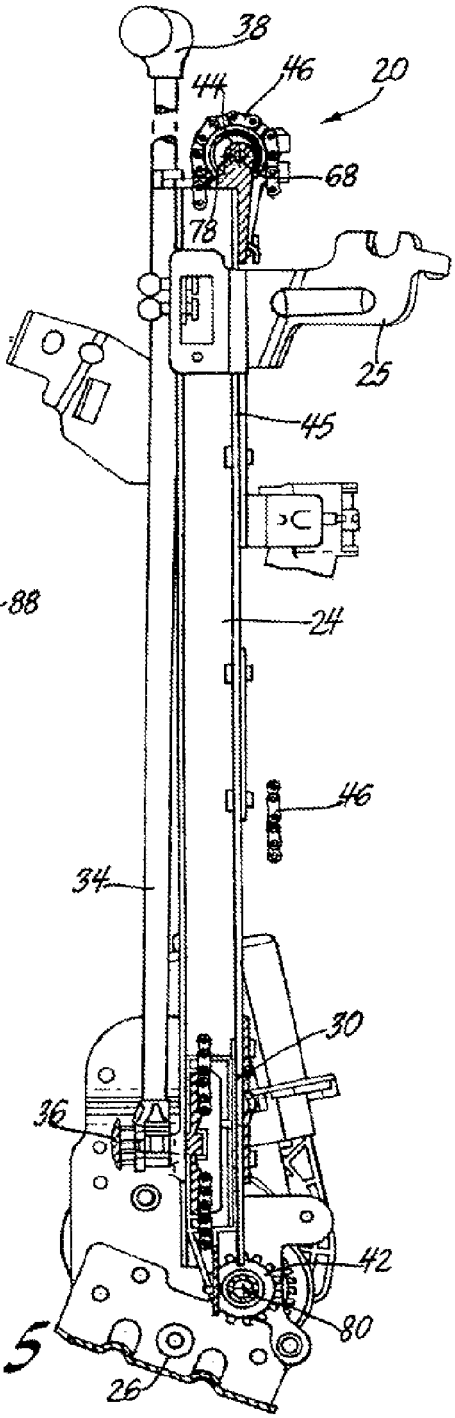
FIG. 5 is a longitudinal section of the drive unit shown in FIG. 2.

Drive unit 20 further comprises a first pulley 42 at a lower end of the guide channel 24 and a second pulley 44 at an upper end of the guide channel. A flexible drive member in the form of a drive chain 46 extends into the upper and lower open ends of guide channel 24. The opposite ends of drive chain 46 are attached to the opposite ends of attachment assembly 30 so that drive chain 46 is in effect, an endless flexible drive member that travels in a loop. The drive chain or flexible drive member 46 is trained solely around pulleys 42 and 44. More specifically drive chain 46 extends up from attachment assembly 30 directly to pulley 44, then wraps substantially 180 degrees around upper pulley 44, then extends directly down to lower pulley 42, then wraps substantially 180 degrees around lower pulley 42 and then extends directly back up to attachment assembly 30 as best shown in FIG. 5. In other words, flexible drive member 46 of drive unit 20 is engaged solely by two pulleys, drive pulley 42 and idler pulley 44 to form the flexible drive member 46 in a narrow loop having a width determined by the diameter of pulleys 42 and 44. Pulleys 42 and 44 preferably have equal diameters. This contributes to a very compact arrangement for drive unit 20. Pulleys 42 and 44 (which are preferably sprockets when a drive chain is used) are aligned with the end wall 45 of rectangular guide channel 24 so that the portions of the drive chain 46 between pulleys 42 and 44 inside as well as outside the guide channel 24 are spaced from the end wall 45.

Drive unit 20 further comprises a bi-directional power unit 48 that is driving connected to the lower pulley 42 so that power unit 20 drives drive chain 46 in one direction to move lift-gate 12 to the open position and in an opposite direction to move lift-gate 12 to the closed position. Power unit 48 is drivingly attached to a pulley at one end of the guide channel 24 for efficient packaging. Power unit 48 is preferably drivingly attached to the lower pulley 42 to minimize the intrusion into the load area of the vehicle but may be drivingly attached to the upper pulley 44. In any event, one pulley is a drive pulley while the other pulley is an idler pulley, or in the case of a chain drive unit, one is an idler sprocket while the other is a drive sprocket.

Bi-directional power unit 48 includes a reversible electric motor 49 and preferably an electromagnetic clutch 50 attached to the lower end of the guide channel 24 by a power unit bracket 51. Electromagnetic clutch 50 is driven by reversible electric motor 49 via a suitable gear set and lower pulley (drive sprocket) 42 is driven by electromagnetic clutch 50 through a second suitable gear set 52.

As indicated above, drive unit 20 includes a pulley 44 at the upper end of guide channel 24 that is an idler pulley or in the case of a chain drive unit, an idler sprocket. Pulley 44 may be part of an adjustable pulley assembly so that slack in flexible drive member 46 may be taken up when flexible drive member 46 is engaged solely by pulleys 42 and 44. A suitable adjustable pulley assembly is described in detail in co-pending patent application Ser. No. 11/217,113 filed Aug. 31, 2005.

Operation

The operation of the power operated closure system is as follows. When lift-gate 12 is in the closed position as shown in solid line in FIG. 1, attachment assembly 30 is at or near the bottom of the elongated slot 27 in guide channel 24 as best shown in FIG. 5. To open lift-gate 12, motor 49 and electromagnetic clutch 50 are energized to rotate lower pulley (drive sprocket) 42 clockwise as viewed in FIG. 5. This moves drive chain 46 clockwise in the loop defined by pulleys 42 and 44 and pulls attachment assembly 30 up in guide channel 24. As attachment assembly 30 is pulled up, lift-gate 12 is moved toward the open position by rod 34. Attachment assembly 30 is pulled up in guide channel 24 until lift-gate 12 is opened at which time assembly 30 is positioned at or near the top of elongated slot 27 in guide channel 24 as shown in phantom in FIG. 1. When lift-gate 12 is opened, a limit switch or the like is actuated to de-energize motor 49 and electromagnetic clutch 50.

Figure 6:
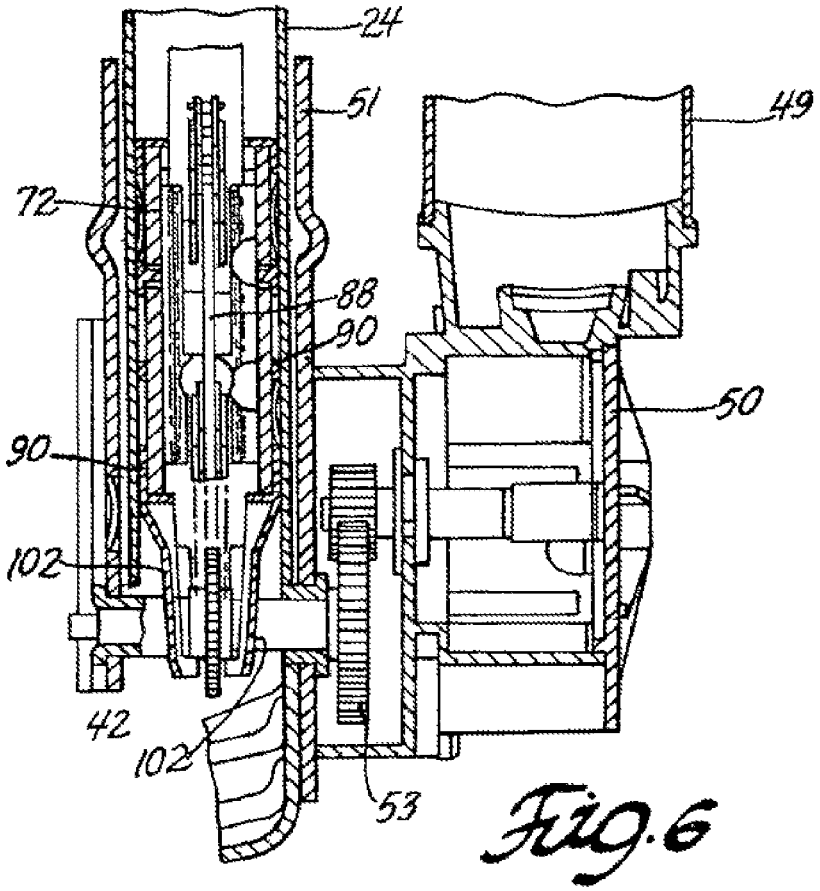
FIG. 6 is another longitudinal section of the lower end of the drive unit shown in FIG. 2.

The open lift-gate 12 shown in phantom in FIG. 1 is closed by energizing motor 49 and electromagnetic clutch 50 to rotate drive sprocket 42 counterclockwise as viewed in FIG. 5. This moves drive chain 46 counterclockwise in its loop and pulls attachment assembly 30 down in guide channel 24. As attachment assembly 30 is pulled down, lift-gate 12 is moved toward the closed position by rod 34. Attachment assembly 30 is pulled down in guide channel 24 until lift-gate 12 is closed at which time attachment assembly 30 is positioned at or near the bottom of elongated slot 27 in guide channel 24 as shown in FIGS. 5 and 6. When lift-gate 12 is closed, a limit switch or the like is actuated to de-energize motor 49 and electromagnetic clutch 50.

The electromagnetic clutch 50 is de-energized after the lift-gate 12 is opened or closed to facilitate manual opening and closing of the lift-gate 12 in the event of power failure. However, the electromagnetic clutch 50 can be eliminated so long as the bi-directional electric motor 49 can be back driven by manual movement of the lift-gate in the event of a power failure.

Figure 7:
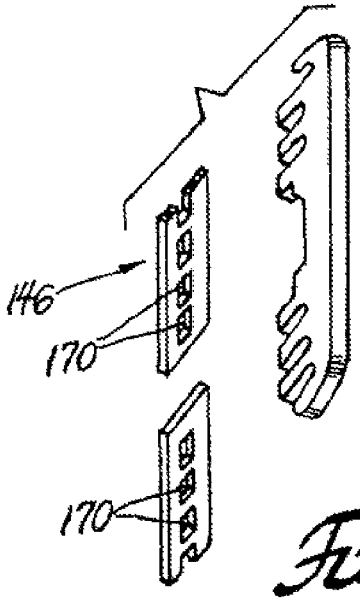
FIG. 7 is a perspective view of an alternate flexible drive member.
Figure 8:
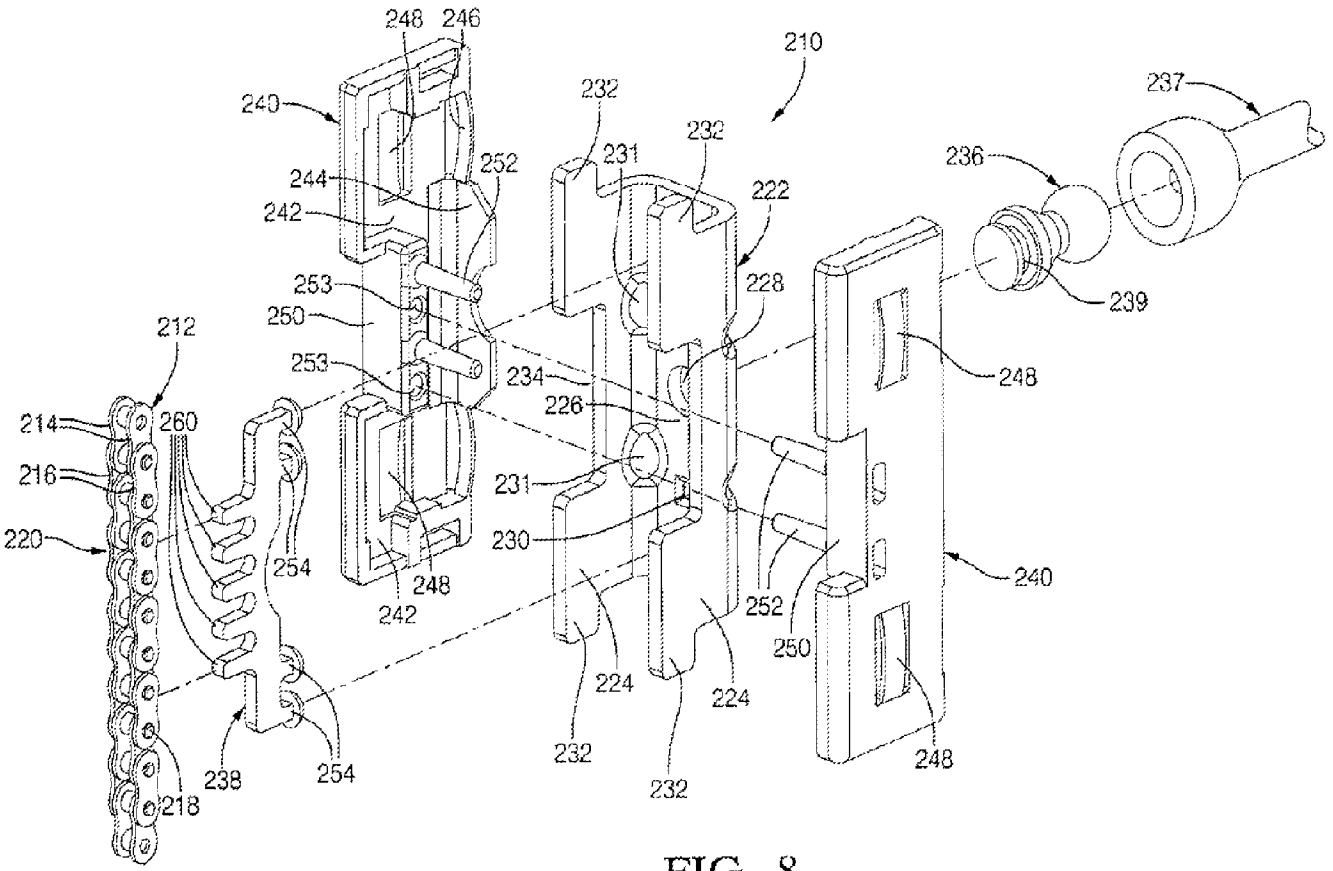
FIG. 8 is an exploded perspective view of another attachment assembly in accordance with the invention in combination with a drive chain.
Figure 9:
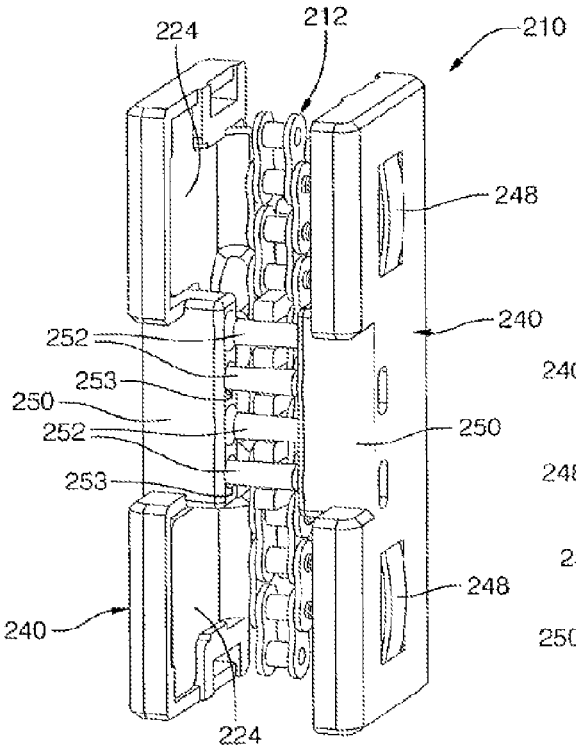
FIG. 9 is a perspective rear view of the attachment assembly of FIG. 8.
Figure 10:
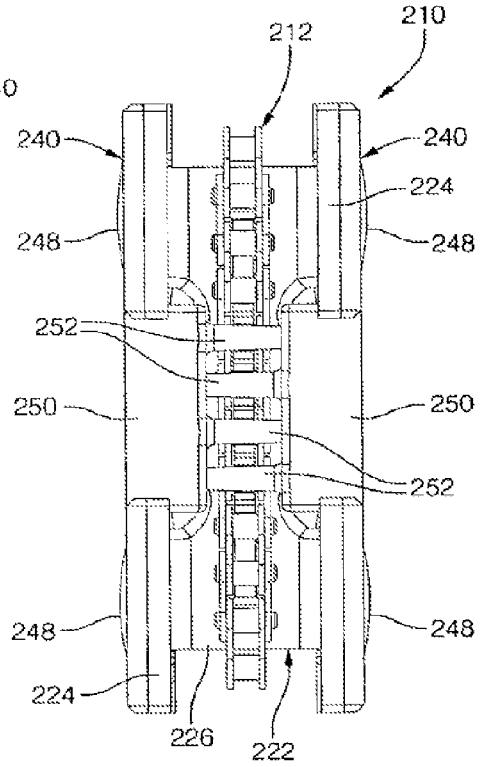
FIG. 10 is a rear view of the attachment assembly of FIG. 8.
Figure 11:
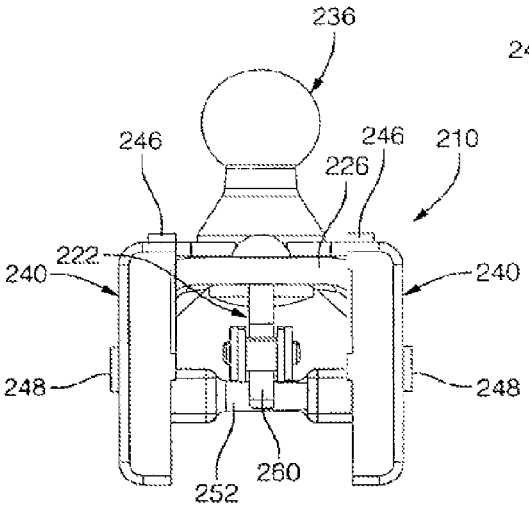
FIG. 11 is a top view of the attachment assembly of FIG. 8.
Figure 12:
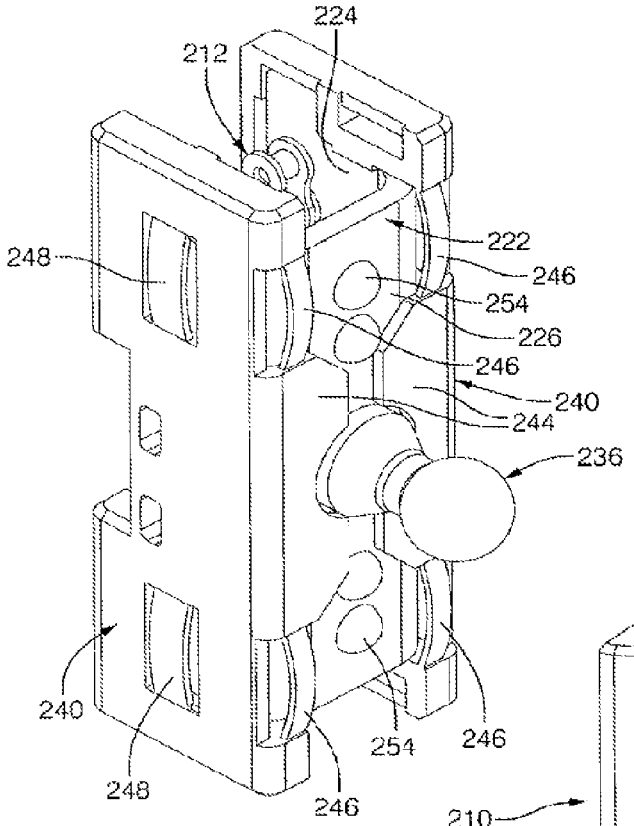
FIG. 12 is a perspective front view of the attachment assembly of FIG. 8.
Figure 13:
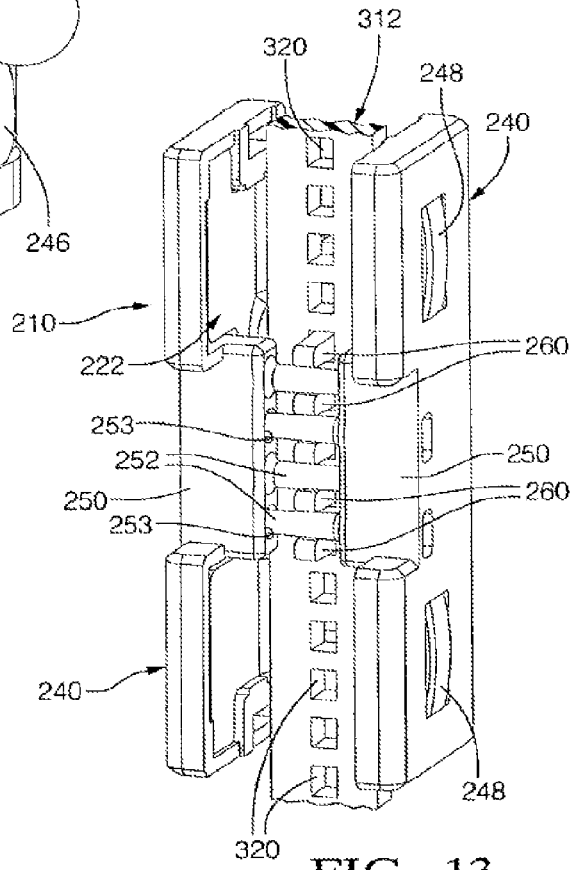
FIG. 13 is a perspective rear view of the attachment assembly of FIG. 8 in combination with a drive tape having spaced windows.

While the flexible drive member 46 is illustrated as being a drive chain 46, any flexible drive member can be used, such as a slotted drive tape 146 that is shown in FIG. 7. In such instances, pulleys 42 and 44 would be modified to cooperate with the slotted drive tape 46A.

Attachment Assembly

Figure 4:
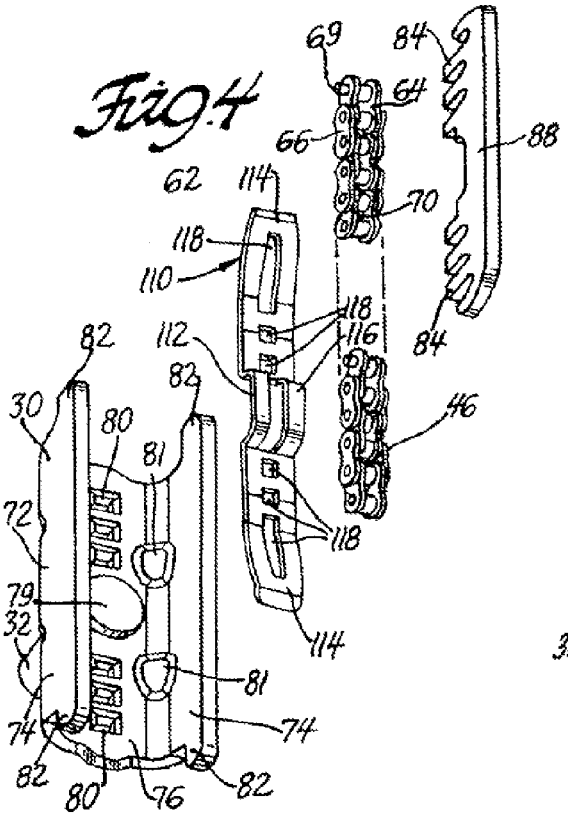
FIG. 4 is an exploded perspective view of the attachment assembly taken from a different angle.

As indicated above, attachment 30 is attached to a flexible drive member in the form of a drive chain 46. Chain 46 comprises inner and outer pairs of metal links 64 and 66 that are connected end-to end by pivot pins 69 forming a plurality of evenly spaced windows 70 as best shown in FIG. 4.

Attachment assembly 30 comprises a yoke 72 that has laterally spaced side walls 74 connected by a bridge wall 76 at one end. Bridge wall 76 has a round central hole (not shown) and a plurality of smaller square holes 80 on either side of the round central hole. Side walls 74 each have inwardly extending, part spherical dimples 81 near the bridge wall 76 to increase the strength and rigidity of yoke 72. Each side wall 74 also has upper and lower feet 82 that extend outwardly. Yoke 72 is preferably of stamped sheet metal construction for economy of manufacture.

Attachment assembly 30 includes the metal ball stud 32 for connecting assembly 30 to a driven member, such as socket ended rod 34, and a metal coupler 88 for connecting attachment assembly 30 to the drive chain 46. Ball stud 32 is suitably attached to bridge wall 76, for example by sticking stud end 79 in the round central hole of yoke 72 and spin riveting ball stud 32 to bridge wall 76. While yoke 72 and ball stud 32 are preferably two separate metal pieces, these elements can be combined into one piece. Moreover for some applications the yoke 72 and ball stud 32 can be of molded plastic construction.

Coupler 88 is also suitably attached to bridge wall 76, for example by riveting coupler 88 to bridge wall 76 as explained below. Coupler 88 is preferably of stamped sheet metal construction for economy of manufacture.

Figure 3:
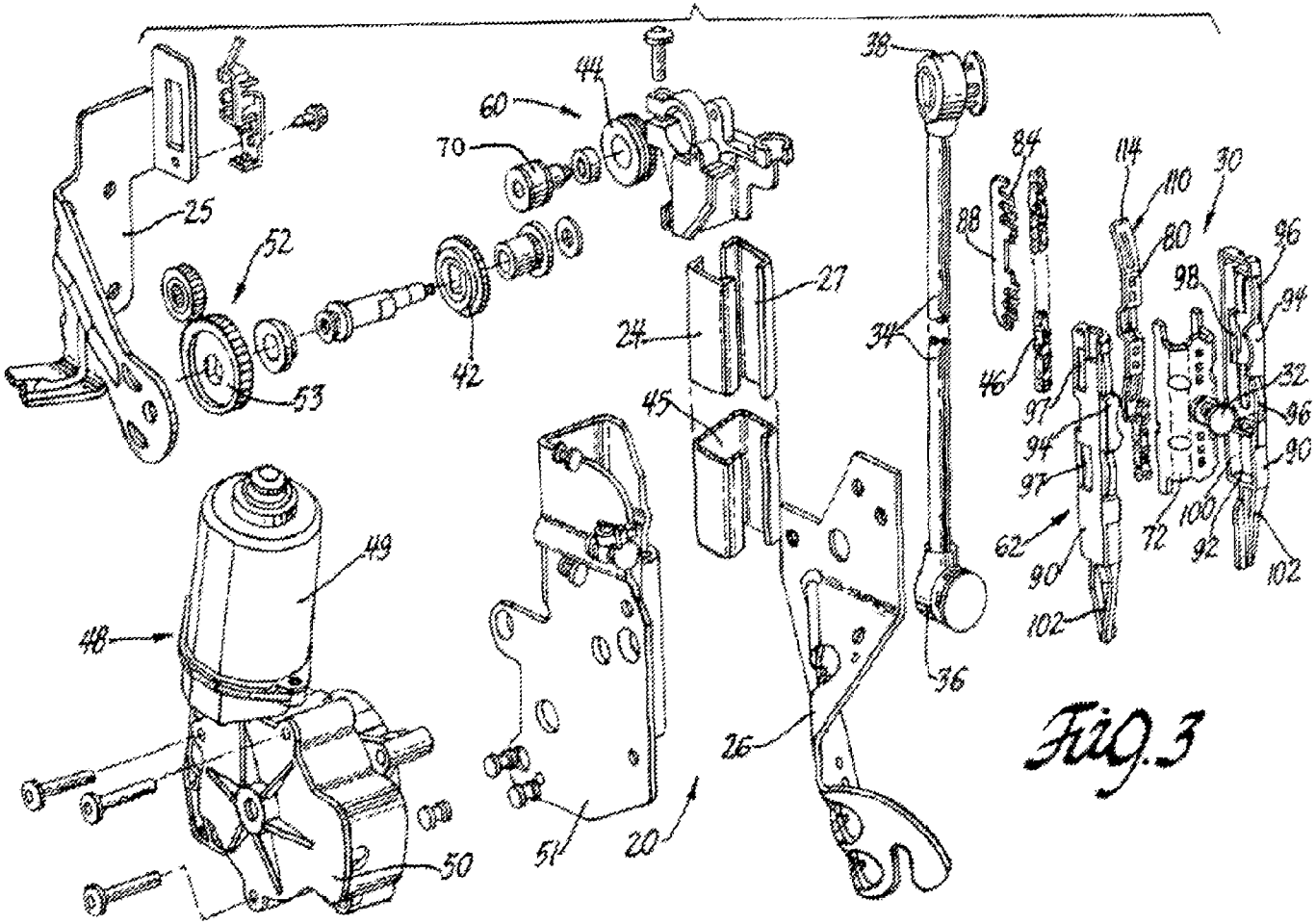
FIG. 3 is a partially exploded perspective view of the drive unit shown in FIG. 2 showing details of the attachment assembly.

Attachment assembly 30 also includes two shoes 90, FIG. 3, which are preferably of molded plastic construction for economy of manufacture. Each shoe 90 has a side wall recess 92 shaped to receive an associate side wall 74 of yoke 72 and a forward central flange 94 that engages bridge wall 76 around ball stud 32 as best shown in FIG. 3. Each shoe 90 has flexible, forward bows 96 on either side of the forward flange 94. Each shoe 90 also has flexible side bows 97 and flexible rearward bows 98 on either side of a rearward flange 100. Each shoe 90 has a depending, flexible tapered finger 102 that cooperates with the other tapered finger 102 as explained below. Shoes 90 are attached to yoke 72 by snap fitting each shoe 90 against one of the respective side walls 74 of yoke 72.

Coupler 88 is disposed between the side walls 74 and yoke 72. Coupler 88 has a plurality of square studs or teeth 84 formed as two sets of three evenly spaced that extend forward and through the square holes 80 with their protruding heads headed over to rivet coupler 88 to bridge wall 76. The two sets of evenly spaced teeth 84 each have at least two teeth that extend through respective ones of the windows 50 of drive chain 46, so that drive chain 12 is secured to yoke 72 by coupler 88 trapping the respective ends of drive chain 46 between the coupler body and the bridge wall 76. The sets of teeth 84 extend through respective windows 50 in each end of drive chain 46 and through the square holes 80 holes in yoke 72 where the free ends are headed. Thus attachment assembly 30 is drivingly attached to drive chain 46 very securely. Shoes 90 house yoke 72 and are preferably equipped with the laterally spaced, resilient, forward bows 96, the laterally spaced, resilient, side bows 97 and the laterally spaced, resilient rearward bows 98 so that the attachment assembly 62 slides easily and without rattling inside a channel such as the channel 24.

Attachment assembly 30 also preferably includes a chain tensioning spring 110. Spring 110 has a central mounting portion 112 with flexible spring arms 114 on each end. Central mounting portion 112 has a central depression 116 (to accommodate the deformed stud end 79 of ball stud 32) and windows 118 on either side of the central depression 116. Spring 110 is attached to assembly 30 by sandwiching mounting portion 112 of spring 110 between coupler 88 and the bridge wall 76 of yoke 72 so that teeth 84 extend through windows 118 when coupler 88 is attached to yoke 72 to connect the ends of chain 46 to attachment assembly 30. When spring 110 and chain 46 are both attached, spring arms 114 engage chain 46 to tension chain 46 and reduce noise.

Attachment assembly 30 preferably includes an anti-rattle feature that is of particular advantage when attachment assembly is used in conjunction with a drive unit that includes a gear set, such as the drive unit 20, that includes the gear set 52. Gear sets almost always include some gear lash. In some applications of the drive unit, for example a lift-gate application, this gear lash can allow the gear wheel 53 to oscillate back and forth rotationally and produce a rattle. To eliminate or at least substantially reduce this rattle, attachment assembly preferably includes the flexible tapered fingers 102 of shoes 90. These flexible tapered fingers 102 engage opposite sides of lower pulley (drive sprocket) 42 with a light clamping force that prevents oscillatory rotation of drive sprocket 42 and gear wheel 53 when the lift-gate is closed as best shown in FIG. 6.

In FIGS. 1-6, the attachment assembly 30 has been illustrated in combination with a length of flexible drive chain 46 of the metal link type. However, the attachment assembly 30 can be used in conjunction with an endless flexible drive chain having its own master link or one which uses the attachment assembly 30 as the master link. Moreover, the attachment assembly 30 can be used in conjunction with other types of flexible drive members, such as the flexible drive belt 146 having regularly spaced windows 170 that is shown in FIG. 7 and in FIG. 6 of U.S. Pat. No. 6,367,864 discussed above.

Alternate Attachment Assembly

Referring now to FIGS. 8-13, another attachment assembly 210 of the invention is illustrated in connection with a flexible drive member having a plurality of evenly spaced windows, such as, a metal drive chain 212. Chain 212 comprises inner and outer pairs of metal links 214 and 216 that are connected end-to end by pivot pins 218 forming a plurality of evenly spaced windows 220.

Attachment assembly 210 comprises a yoke 222 that has laterally spaced side walls 224 connected by a bridge wall 226 at one end. Bridge wall 226 has a round central hole 228 and a plurality of smaller square holes 230 on either side of the round central hold 228. Side walls 224 each have inwardly extending, part spherical dimples 231 near the bridge wall 226 to increase the strength and rigidity of yoke 222. Each side wall 224 also has upper and lower feet 232 that extend outwardly and that are separated by a central slot 234 at the rearward end of yoke 222. Yoke 222 is preferably of stamped sheet metal construction for economy of manufacture.

Attachment assembly 210 includes a metal ball stud 236 for connecting attachment 210 to a driven member, such as socket ended rod 237, and a metal coupler 238 for connecting the attachment 210 to the drive chain 212. Ball stud 236 is suitably attached to bridge wall 226, for example by sticking stud end 239 in hole 228 and spin riveting ball stud 236 to bridge wall 226. Coupler 238 is also suitably attached to bridge wall 226, for example by riveting coupler 238 to bridge wall 226 as explained below. Coupler 228 is preferably of stamped sheet metal construction for economy manufacture.

While yoke 222, ball stud 236 and coupler 238 are preferably three separate metal pieces, these elements can be combined into one or two pieces. Moreover for some applications the yoke 222, ball stud 236 and coupler 238 can be of molded plastic construction.

Attachment assembly 210 also includes two shoes 240 that are preferably of molded plastic construction for economy of manufacture. Each shoe 240 has a side wall recess 242 shaped to receive an associated side wall 224 of yoke 222 and a forward central flange 244 that engages bridge wall 226 around ball stud 236. Each shoe 240 has flexible, forward bows 246 on either side of the forward flange 244. Each shoe 240 also has flexible side bows 248 on either side of a rearward flange 250. Each rearward flange 250 has two tapered fingers 252 that extend toward the other flange with their tips disposed in sockets 253 of the other flange. Shoes 240 are attached to yoke 222 by attaching shoes 240 to each other by interconnecting fingers 252 and sockets 253 so that shoes 240 lie against the respective side walls 224 of yoke 222 with their rearward flanges 250 extending through respective slots 234.

Coupler 238 is disposed between the side walls 224 of yoke 222. Coupler 238 has a plurality of square studs 254 extending forward and through the square holes 230 with their protruding heads headed over to rivet coupler 238 to bridge wall 226. Coupler 238 also has a plurality of evenly spaced teeth 256 extending rearward and through respective ones of the windows 220 of drive chain 212. Drive chain 212 is trapped in yoke 222 by the tapered fingers 252 of shoes 240 which extend through respective spaces between adjacent teeth 256 of coupler 238 behind drive chain 212 and into associated sockets 253 of the other shoe. Thus attachment 210 is drivingly attached to drive chain 212 very securely. Shoes 240 house yoke 212 and are preferably equipped with the laterally spaced, resilient, forward bows 246 and the laterally spaced, resilient, side bows 248 so that the attachment 210 can slide easily and without rattling inside a channel such as the channel 24 discussed above in connection with FIGS. 2 through 6.

In FIGS. 8-13, the attachment assembly 210 has been illustrated in combination with a length of flexible drive chain of the metal link type. However, the attachment assembly 210 can be used in conjunction with an endless flexible drive chain having its own master link or one which uses the attachment assembly 210 as the master link. Moreover, the attachment assembly 210 can be used in conjunction with other types of flexible drive members, such as the flexible drive belt 146 having regularly spaced windows 170 that is shown in FIG. 7 and in FIG. 6 of U.S. Pat. No. 6,367,864 discussed above.

The attachment assemblies 30 and 210 may be used on power operated liftgates or sliding doors of automobiles or minivans as indicated by U.S. Pat. No. 6,387,864. However, the attachment assemblies 30 and 210 have many other uses-virtually any application or operating system involving a flexible drive member having spaced windows. In other words, it will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

Adjustable Pulley Assembly

Figure 14:
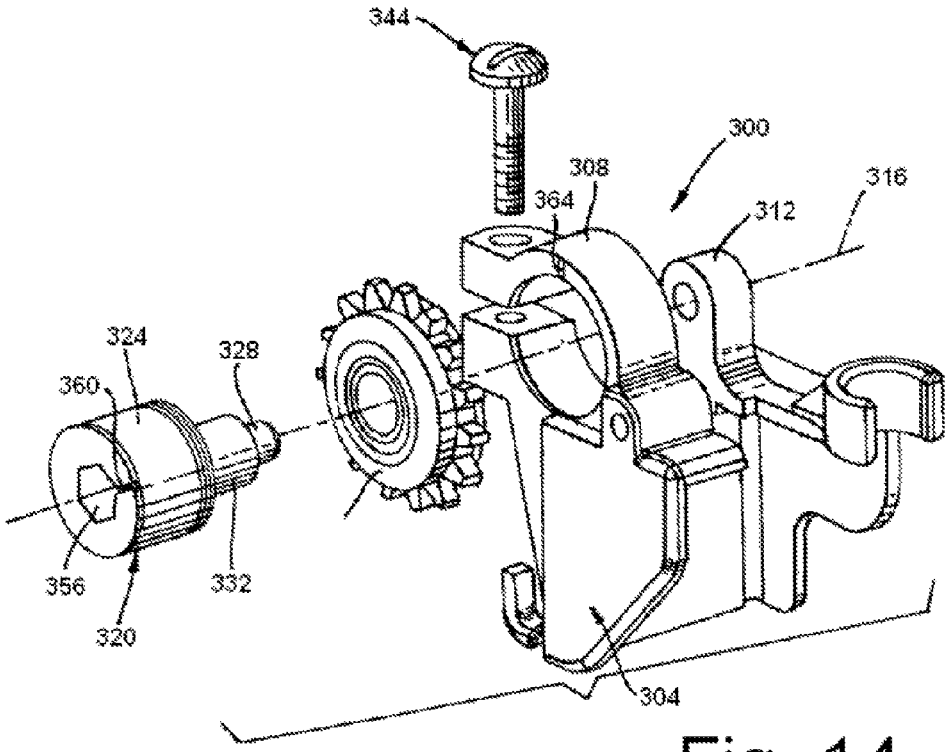
FIG. 14 is an enlarged exploded perspective view of the adjustable pulley assembly shown in FIG. 2.
Figure 16:
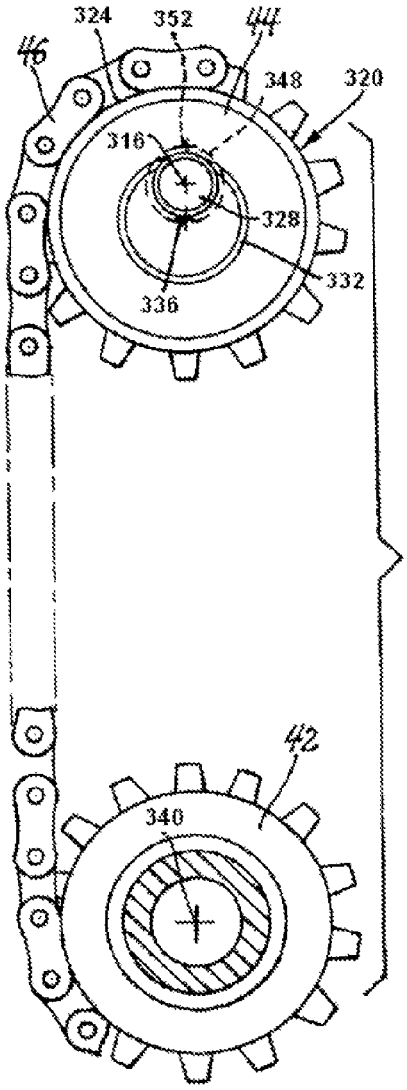
FIG. 16 is a schematic view of the drive unit shown in FIG. 15.
Figure 15:
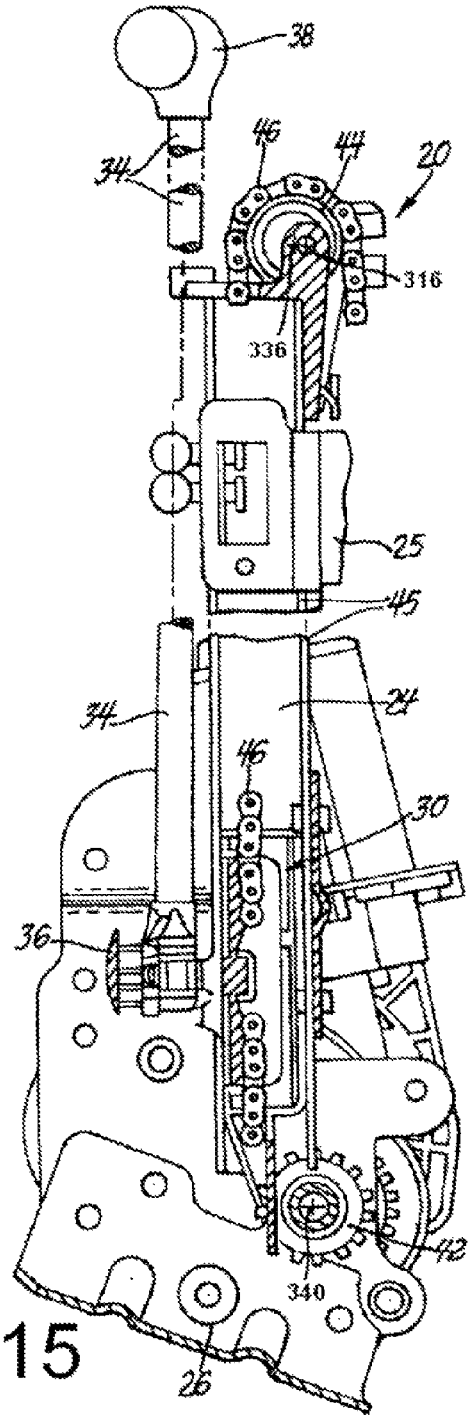
FIG. 15 is a longitudinal section of the drive unit shown in FIG. 2.

As indicated above, drive unit 20 includes a pulley 44 at the upper end of guide channel 24 that is an idler pulley or in the case of a chain drive unit, an idler sprocket. Pulley 44 is part of an adjustable pulley assembly 300 that includes a housing 304 that is attached to the upper end of guide channel 24 as best shown in FIGS. 14-16. Housing 304 has a first journal box 308 and a second journal box 312 located on a fixed housing axis 316 that is generally coplanar with or closely parallel to the end wall 45 of the guide channel 24. Journal boxes 308 and 312 are spaced axially from each other to provide space for pulley 44.

Pulley assembly 300 also includes a camshaft 320 having axially spaced concentric bearing portions 324 and 328 that are disposed in the first journal 308 and the second journal box 312, respectively for rotation about the fixed housing axis 316. Camshaft 320 has a cam 332 between the bearing portions 324 and 328. Cam 332 is circular having a center that defines an adjustable pulley axis 336 that is substantially parallel to and offset from the fixed housing axis 316 defined by the bearing portions 324 and 328 disposed in the journal boxes 308 and 312. Pulley 44 is disposed between journal boxes 64 and 66 and rotationally supported on circular cam 76 for rotation about the adjustable pulley axis 78.

Cam shaft 320 can be clamped in housing 304 in a variety of rotational positions about the fixed housing axis 316 of housing 304 to adjust the location of the adjustable pulley axis 336 with respect to housing 304 and the fixed housing axis 316. Pulley 42 at the lower end of the guide channel 24 rotates about a fixed pulley axis 340 that is fixed with respect to the guide channel 24 by the power unit bracket 51 and that preferably is substantially coplanar with end wall 45. Thus the adjustment of cam shaft 320 adjusts the location of the adjustable pulley axis 336 and pulley 44 with respect to the fixed pulley axis 340 of pulley 42 as explained further below.

Journal box 308 is an open journal box in the form of a generally C-shaped clamp while journal box 312 is preferably a closed journal box in the interests of design simplicity and manufacturing economy. Cam shaft 320 is also preferably shaped so that bearing portion 324 is larger than cam 332 which is turn is larger than bearing portion 328 so that cam 332 and bearing portion 328 can be inserted through journal box 308 to facilitate assembly of cam shaft 320 to housing 304.

Open journal box 308 also includes a lock 344 in the form of a screw or the like to clamp the journal box 308 into tight engagement with the bearing portion 324 to fix the rotational position of the cam shaft 320 in the housing 304. The surface of the bearing portion 324 is preferably knurled or otherwise roughened to enhance the clamping action of the journal box 308.

When the drive unit 48 is assembled, the flexible drive member (drive chain) 46 may have slack due to manufacturing tolerances. This slack can be eliminated or at least substantially reduced by operation of the adjustable pulley assembly 300. Referring now to FIG. 16, the drive unit 48 is illustrated with the movable or adjustable pulley axis 336 at a minimum distance from the fixed pulley axis 340 where the adjustable pulley axis 336 lies between the fixed pulley axis 340 and the fixed housing axis 316. However, the adjustable pulley axis 336 can be moved anywhere in a fixed orbit or circle 348 around the fixed housing axis 316 by rotating the cam shaft 320 in the housing 304 about the fixed housing axis 316. Rotation of cam shaft 320 in either the clockwise direction or the counterclockwise direction increases the distance between the adjustable pulley axis 336 and the fixed pulley axis 340 thus reducing any slack in the flexible drive member 46. The maximum adjustment occurs when the adjustable pulley axis is located as shown at point 352 which is at a half turn or 180 degrees from the minimum distance position shown in FIG. 16. It should be noted that the amount of slack that can be taken up by the adjustable pulley assembly 300 is twice the diameter of the adjustment orbit 348 because slack is taken up in both portions of the loop of flexible drive member 46 between the pulleys 42 and 44 when the distance or length between the pulley axes 336 and 340 is increased. Thus substantial slack in flexible drive member 46 may be taken up even when flexible drive member 46 is engaged solely by pulleys 42 and 44. Additional slack or tensioning of the flexible drive member may be taken up by attachment assembly 30 that is disclosed and described in detail in co-pending patent application Ser. No. 11/221,499 filed Sep. 8, 2005.

Cam shaft 320 preferably includes a hexagonal or other non-circular socket portion 356 at one end to receive a tool (not shown) to rotate cam shaft 320 about the fixed housing axis 316 and adjust the position of the pulley axis 336. Cam shaft 320 and housing 304 also preferably include cooperating indicia to indicate the position of the adjustable pulley axis 336 with respect to the fixed housing axis 316, such as scribe lines 360 and 364.

Furthermore, while the adjustable pulley assembly 300 has been disclosed in connection with an idler pulley 44, the adjustable pulley assembly 300 can be used in connection with a drive pulley, such as the drive pulley 42, or with both the idler pulley 44 and the drive pulley 42. In other words, while the present invention has been described as carried out in a specific embodiment thereof, it is not intended to be limited thereby but is intended to cover the invention broadly within the scope and spirit of the appended claims.

The invention claimed is:

1. A drive unit comprising:

a guide channel;

a first pulley positioned proximate one end of the guide channel, where the first pulley is rotatable about a fixed pulley axis;

a flexible drive member having a plurality of spaced windows;

an attachment assembly moveably attached to the guide channel, the attachment assembly comprising, a yoke having laterally spaced side walls connected by a bridge wall, the yoke having a connector attached to the bridge wall, a coupler having a plurality of spaced teeth that are adapted to extend through the plurality of spaced windows of the flexible drive member, and a spring that has a central mounting portion and spring arms at each end, the central mounting portion being sandwiched between the bridge wall and the coupler; and an adjustable pulley assembly coupled to the guide channel substantially opposite the first pulley, the adjustable pulley assembly having a second pulley that rotates around a moveable pulley axis that can be adjusted with respect to the fixed pulley axis to adjust the slack in the flexible drive member.

2. The drive unit of claim 1, wherein the attachment assembly includes an outer shoe adjacent each side wall of the yoke, each outer shoe having a forward flange that engages the bridge wall and a rearward flange that engages a rearward edge of the associated side wall.

3. The drive unit of claim 1, wherein one of the first pulley and the second pulley is a drive pulley and the other of the first pulley and the second pulley is an idler pulley.

4. The drive unit of claim 1, further comprising a power unit attached to the guide channel to drive the first pulley or the second pulley.

5. The drive unit of claim 1, wherein the adjustable pulley assembly includes a housing having axially spaced journal boxes defining a fixed housing axis, and a cam shaft that rotates in the journal boxes about the fixed housing axis to define the moveable pulley axis.

6. The drive unit of claim 5, wherein the cam shaft has axially spaced bearing portions disposed in the axially spaced journal boxes and a circular cam portion positioned between the axially spaced bearing portions that defines the moveable pulley axis, wherein the cam shaft rotates about the fixed housing axis to adjust the distance between the fixed pulley axis and the moveable pulley axis.

7. The drive unit of claim 1, wherein the plurality of spaced teeth extend through holes in the bridge wall of the yoke.

8. A drive unit comprising:

a guide channel;

a first pulley positioned proximate one end of the guide channel, where the first pulley is rotatable about a fixed axis;

an adjustable pulley assembly positioned opposite the first pulley, the adjustable pulley assembly including a second pulley rotatable about a moveable pulley axis and moveable into a plurality of positions to change the distance between the fixed pulley axis and the moveable pulley axis, and wherein the adjustable pulley assembly may be fixed in at least one of the plurality of positions;

a flexible drive member trained solely around the first pulley and the second pulley to form the flexible drive member in a narrow loop, and wherein the adjustable pulley assembly takes up a set amount of slack in the flexible drive member in each of the plurality of positions;

an attachment assembly moveable along the guide channel and coupled to the flexible drive member, the attachment assembly including a flexible drive member tensioning device, and wherein the flexible drive member tensioning device is configured to take up additional slack in the flexible drive member beyond the set amount of slack taken up by the adjustable pulley assembly; and wherein the adjustable pulley assembly includes a housing having axially spaced journal boxes defining a fixed housing axis and a cam shaft rotatable about the fixed housing axis to define the moveable pulley axis.

9. The drive unit of claim 8, wherein the cam shaft has axially spaced bearing portions disposed in the axially spaced journal boxes and a circular cam portion positioned between the axially spaced bearing portions that defines the moveable pulley axis.

10. The drive unit of claim 9, wherein the second pulley rotates about the circular cam portion.

11. The drive unit of claim 8, wherein the flexible drive member tensioning device includes a spring.

12. The drive unit of claim 8, wherein the first pulley is a drive pulley and the second pulley is an idler pulley.

13. A drive unit comprising:

a guide channel having a first pulley rotatable about a fixed pulley axis and a second pulley positioned opposite the first pulley;

an attachment assembly movable along the guide channel;

a flexible drive member trained solely about the first and second pulleys to form the flexible drive member in a narrow loop, the flexible drive member extending a first length and being formed from inelastic material, the flexible drive member having a first end directly coupled to the attachment assembly and a second end opposite the first end, the second end directly coupled to the attachment assembly;

a first flexible drive member tensioning device adjustable into one of a plurality of fixed positions, each position operable to take up a set amount of slack in the flexible drive member; and a second flexible drive member tensioning device disposed on the attachment assembly and having a spring to take up slack in addition to the set amount of slack taken up by the first flexible drive member tensioning device, wherein the second flexible drive member tensioning device operates independently of the first flexible drive member tensioning device; and wherein the first flexible drive member tensioning device and the second flexible drive member tensioning device create tension within the flexible drive member, and wherein the tension is constant along the entire length of the flexible drive member.

14. The drive unit of claim 13, wherein the second flexible drive member tensioning device includes a spring.

15. The drive unit of claim 13, wherein the first flexible drive member tensioning device includes an adjustable pulley assembly positioned opposite the first pulley, the adjustable pulley assembly including the second pulley rotatable about a moveable pulley axis that can be adjusted to change the distance between the fixed pulley axis and the moveable pulley axis.

* * * * *